US006266035B1

(12) United States Patent
Palalau

(10) Patent No.: US 6,266,035 B1
(45) **Date of Patent: *Jul. 24, 2001**

(54) ELD DRIVER WITH IMPROVED BRIGHTNESS CONTROL

(75) Inventor: Silviu Palalau, Birmingham, MI (US)

(73) Assignee: Lear Automotive Dearborn, Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/961,363

(22) Filed: Oct. 30, 1997

(51) Int. Cl.[7] ..... G09G 3/30

(52) U.S. Cl. ..... 345/77; 345/76; 345/78; 345/79

(58) Field of Search ..... 345/36, 42, 45, 345/76–80, 90, 98, 147, 148; 340/781; 315/169

(56) References Cited

U.S. PATENT DOCUMENTS

| | | | | |
|---|---|---|---|---|
| 4,559,535 | | 12/1985 | Watkins et al. . | |
| 4,691,144 | * | 9/1987 | King et al. | 315/169.3 |
| 4,839,563 | * | 6/1989 | Boudreau et al. | 315/169.3 |
| 4,975,691 | * | 12/1990 | Lee | 345/79 |
| 4,996,523 | * | 2/1991 | Bell et al. | 340/781 |
| 5,075,596 | * | 12/1991 | Young et al. | 315/169.3 |
| 5,459,495 | * | 10/1995 | Scheffer et al. | 345/147 |
| 5,517,207 | * | 5/1996 | Kawada et al. | 345/78 |
| 5,602,559 | * | 2/1997 | Kimura | 345/89 |
| 5,781,168 | * | 7/1998 | Osada et al. | 345/76 |
| 5,786,797 | * | 7/1998 | Kapoor et al. | 345/79 |
| 5,898,414 | * | 4/1999 | Awamoto et al. | 345/55 |
| 5,999,150 | * | 12/1999 | Nighan et al. | 345/79 |
| 6,049,324 | * | 4/2000 | Palalau et al. | 345/147 |

FOREIGN PATENT DOCUMENTS

| | | |
|---|---|---|
| 0762374 | 3/1997 | (EP) . |
| 0778556 | 6/1997 | (EP) . |
| 2740598 | 4/1997 | (FR) . |
| 2164776 | 3/1986 | (GB) . |

OTHER PUBLICATIONS

Mano et al., "TFT–LCD Drive Method and Driver LSI", 1996, pp. 177–182.

* cited by examiner

*Primary Examiner*—Almis R. Jankus
*Assistant Examiner*—Henry N. Tran
(74) *Attorney, Agent, or Firm*—Niro, Scavone, Haller & Niro

(57) ABSTRACT

A display system generally comprises an ELD including a plurality of pixels each activated by a voltage across an inner and outer electrode. A controller applies voltages to each of the pixels via the inner and outer electrodes at a refresh rate to illuminate the pixels. The controller varies the voltage and refresh rates of each of the plurality of pixels in order to provide varying levels of brightnesses of the pixels.

20 Claims, 1 Drawing Sheet

ELD DRIVER WITH IMPROVED BRIGHTNESS CONTROL

BACKGROUND OF THE INVENTION

The present invention relates generally to electroluminescent displays ("ELDs") and more particularly to an ELD and ELD driver with improved brightness control.

ELDs comprise a matrix of pixels, each located at an intersection of a column and a row electrode. Electroluminescent material between the row and column electrodes illuminates when there is a voltage potential across the row and column electrodes. The voltage on the column electrodes is controlled by a column driver. The voltage on the row electrodes is controlled by a row driver. Typically, a voltage potential is applied sequentially to each of the row electrodes while a voltage is applied to the appropriate column electrodes to illuminate selected pixels in each row.

The brightness of each pixel in the ELD is related to the voltage across the pixel. Although the brightness can be controlled by varying voltage, there are several drawbacks. The brightness of the ELD is difficult to control with the voltage. For a given voltage, the rightness between two ELD panels may vary. The brightness of the ELD may also vary with temperature for a given voltage. Further, implementing more than a few voltage levels is expensive. Thus, even sixteen-level shades are expensive to implement using voltage control.

Some ELDs utilize variations in refresh rate to achieve brightness control. Generally, if a pixel is illuminated at a higher refresh rate, it will appear brighter to the human eye. If the pixel is illuminated less frequently, it will appear dimmer to the human eye. In order to implement brightness control, a single video frame may be displayed at a refresh rate several times higher than the video frame rate. For maximum brightness, a pixel would be illuminated during each of the several refresh cycles. By decreasing the number of times a pixel is illuminated over the number of refresh cycles, the apparent brightness of the pixel is controlled. However, this method is also expensive. In order to implement sixteen-level brightness, the refresh rate must be at least fifteen times the frame rate. 60 Hz is generally considered the minimum displayed frame rate to avoid flickering. Thus, the refresh rate to achieve sixteen-level brightness would have to be 900 Hz. Column and row drivers which have to refresh each of the pixels at 900 Hz are expensive. Increasing the number of shade levels further rapidly increases the cost even more.

SUMMARY OF THE INVENTION

The present invention provides a display system comprising an ELD controller which varies the voltage and refresh rate selectively in order to provide different brightness levels among the pixels in an ELD display. For each of the voltages which is available to be applied to the pixels, each of the available refresh rates is also available. As a result, the number of available brightnesses for each of the pixels is generally proportional the number of available voltages times the number of available refresh rates. The display system of the present invention is thus simpler and less expensive than those previously known.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
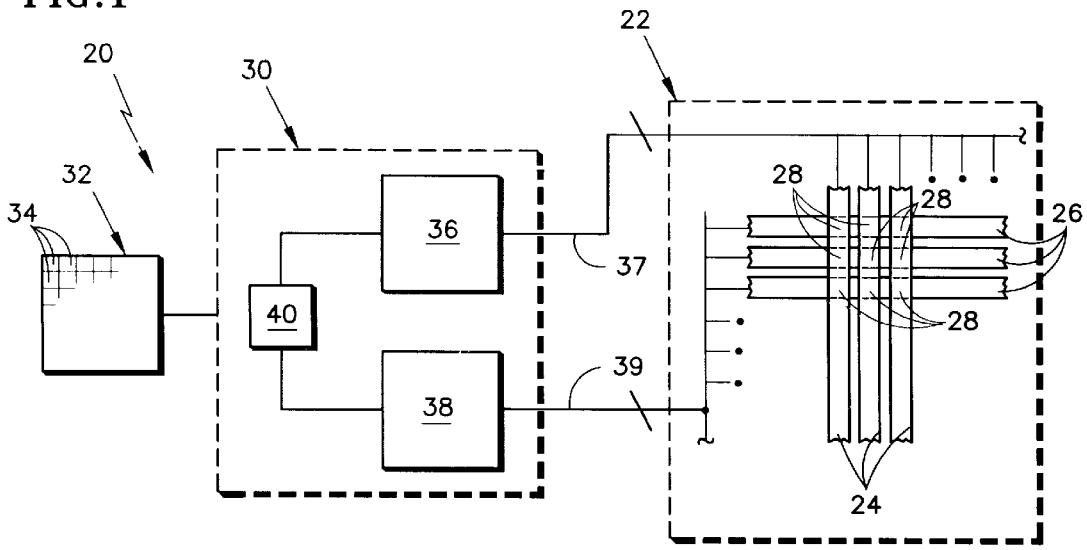
FIG. 1 is a schematic of the display system of the present invention.

A display system 20 according to the present invention is shown in FIG. 1 including an electroluminescent display panel ("ELD") 22. The ELD 22 is generally as is known in the art and comprises a plurality of generally parallel outer, or "column," electrodes 24 and a plurality of generally parallel inner, or "row," electrodes 26, perpendicular to the column electrodes 24. As is well known in the art, an electroluminescent material is disposed between the column electrodes 24 and row electrodes 26. The electroluminescent material between each column electrode 24 and row electrode 26 comprises a pixel 28. Each pixel 28 is illuminated by a voltage potential across the corresponding column and row electrodes 24, 26. The brightness of the pixel 28 is generally a function of the voltage potential across the column and row electrodes 24, 26. As is generally known, the outer electrode, which in this case is the column electrodes 24, are generally of a transparent conductive material (ITO). The electroluminescent material may comprise zinc sulfide doped with manganese. Other details of this structure of the ELD 22 are generally known in the art.

The display system 20 further includes an ELD controller 30 which receives video frames 32 comprising pixel brightness information 34 (shown in a matrix for illustrative purposes) at a video frame rate, preferably 60 Hz. The ELD controller 30 includes a column driver 36 generating voltages at a plurality of column terminals 37 to be applied to the column electrodes 24 and a row driver 38 generating voltages at a plurality of row terminals 39 to be applied to the row electrodes 26. The column driver 36 selectively applies voltages to the column electrodes 24 and the row driver 38 selectively applies voltages to the row electrodes 26 according to the video frame 32, including the pixel brightness information 34, which is stored in RAM 40. Generally, the row driver 38 sequentially applies a voltage to the row electrodes 26, preferably plus 180 volts or minus 140 volts alternately. While each row electrode 26 is activated, the column driver 36 selectively applies voltages to each of the column electrodes 24. The column driver 36 preferably applies voltages of 0, 20 or 40 volts selectively to each of the column electrodes 24. In this manner, potential difference across each pixel may be 180, 160, 140, −140, −160, −180, selectively. Further, the row driver 38 preferably activates the row electrodes 26 at a multiple of the video frame rate, preferably six times the video frame rate, i.e. 360 Hz. Thus, for each video frame 32, the ELD 22 is refreshed six times. Of course, non-integer multiples could also be utilized.

In order to vary brightness, each pixel 28 in the ELD 22 is selectively refreshed from zero to six refresh cycles for each video frame 32. Further, each pixel 28 is selectively refreshed at any of three available voltage differences.

As is known, the voltage differences applied to each pixel 28 must alternate between positive and negative. The apparent brightness of the pixel 28 will generally be the average of the absolute value of the potential difference. Thus, if in the first refresh cycle the potential difference across a pixel 28 is 180 volts and in the second refresh cycle is -160 volts, the apparent brightness of the pixel will be generally equal to the brightness of the pixel 28 at 170 volts.

The column driver 36 and row driver 38 activate the column electrodes 24 and row electrodes 26 according to the video frame information 32 including the pixel brightness information 34 stored in RAM 40. Various techniques for varying the refresh rate of pixels 28 in the ELD 22 are known. For example, the video frame 32, including the pixel brightness information 34, may be decoded and stored in RAM 40 for each of the refresh cycles. A selected pixel 28 is activated in all, none or some of the refresh cycles. A preferred method for varying refresh rate is discussed in detail in copending application Ser. No. 08/961,364, filed on even date herewith, entitled "Memory Configuration for Gray Shade ELD Using ON/OFF Drivers" which is assigned to the assignee of the present invention and hereby incorporated by reference.

Figure 2:
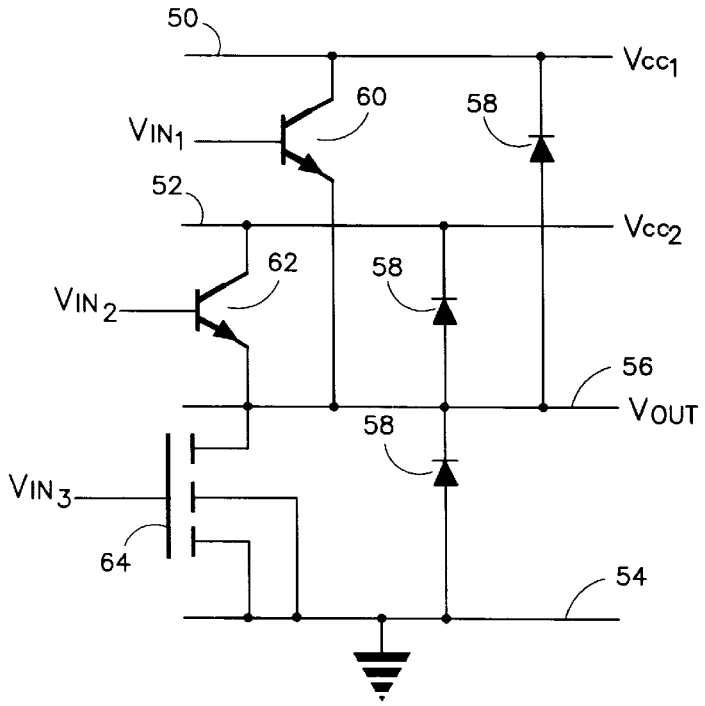
FIG. 2 is a schematic of one embodiment of the column driver of FIG. 1.

One embodiment for one column of the column driver 36 of FIG. 1 is shown in FIG. 2. The column driver 36 would include a plurality of these circuits, one for each column electrode 24. The column driver 36 generally includes a first voltage supply 50, again, preferably 40 volts. The column driver 36 further includes a second voltage supply 52, again, preferably 20 volts. The column driver 36 preferably further includes a third voltage supply or ground 54. Each of the voltage supplies 50, 52, 54 is connected to the column terminal 37 of the column driver 36 via diodes 58. Further, each of the voltage supplies 50, 52, 54 is connected to the column terminal 37 by a first transistor 60, second transistor 62 and third transistor 64, respectively. Based upon information stored in RAM 40, (FIG. 1), the column driver 36 selectively drives one of the first, second and third transistors 60, 62, 64. In this manner, one of the three available voltages is applied to the column terminal 37.

Those skilled in the art will develop other structures and techniques which could be utilized to selectively vary the voltages and refresh rates applied to the pixels 28 in the ELD 22. It should also be noted that the terms "column" and "row" electrodes are relative terms, as either could be the inner or outer electrode. Further, either of the column or row electrodes 24, 26 could be operated sequentially, with the other operated selectively. Thus, except as may be specified otherwise, the terms "row" and "column" throughout the specification and claims shall be used only to distinguish one set of electrodes from the other.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A display system for displaying information as a succession of video frames, comprising:

a display comprising a plurality of pixels, each pixel exhibiting one of a plurality of brightnesses when activated by applying a respective one of a corresponding plurality of different voltages thereto, where one of the voltages is zero and where a pixel to which the zero voltage is applied exhibits zero brightness; and a controller for controlling an apparent brightness of each pixel over a video frame by dividing the video frame into a plural total number of cycles of equal duration and applying, to the pixel, a selected one of the voltages during each of the cycles, wherein a number of cycles in the video frame in which a non-zero voltage is applied to the pixel constitutes a refresh rate for the pixel for the video frame, wherein the refresh rate is selected to be a number from zero to the total number of cycles, wherein each non-zero voltage applied to the pixel during the video frame has a polarity opposite to a polarity of a just preceding non-zero voltage applied to the pixel during the video frame, and wherein the apparent brightness of the pixel over the video frame is determined by the selected refresh rate and the selected voltage applied in each cycle in accordance with the information of the video frame.

2. The display system of claim 1, wherein said controller receives the video frames at a video frame rate, each of the video frames including brightness information for each of said plurality of pixels.

3. The display system of claim 1, wherein said display is an electroluminescent display.

4. The display system of claim 1, wherein said display includes a plurality of column electrodes intersecting a plurality of row electrodes, the intersections of said column and row electrodes forming said pixels.

5. The display system of claim 4, wherein said controller alternately applies a positive and a negative voltage to said row electrodes.

6. The display system of claim 5, wherein said controller simultaneously applies a first voltage to a first column electrode and a second voltage to a second column electrode, said first voltage exceeding said second voltage.

7. The display system of claim 6, wherein said controller selects a refresh rate for said first column electrode to be greater than a refresh rate for said second column electrode.

8. The display system of claim 6, wherein said controller simultaneously applies the first voltage to said first column electrode, the second voltage to said second column electrode and a third voltage to a third column electrode, said third voltage exceeding said first voltage.

9. A method for displaying information as a succession of video frames on a display comprising a plurality of pixels, each pixel exhibiting one of a plurality of brightnesses when activated by applying a respective one of a corresponding plurality of different voltages thereto, where one of the voltages is zero and where a pixel to which the zero voltage is applied exhibits zero brightness, comprising the steps of:

dividing a video frame into a plural total number of cycles of equal duration; and controlling an apparent brightness of a pixel over the video frame by applying, to the pixel, a selected one of the voltages during each of the cycles, wherein a number of cycles in the video frame in which a non-zero voltage is applied to the pixel constitutes a refresh rate for the pixel for the video frame, wherein the refresh rate is selected to be a number from zero to the total number of cycles, wherein each non-zero voltage applied to the pixel during the video frame has a polarity opposite to a polarity of a just preceding non-zero voltage applied to the pixel during the video frame, and wherein the apparent brightness of the pixel over the video frame is determined by the selected refresh rate and the selected voltage applied in each cycle in accordance with the information of the video frame.

10. The method of claim 9, wherein the display receives the video frames at a video frame rate, each of the video frames including brightness information for each of the plurality of pixels.

11. The method of claim 9, wherein the display is an electroluminescent display.

12. The method of claim 9, wherein the display includes a plurality of column electrodes intersecting a plurality of row electrodes, the intersections of the column and row electrodes forming the pixels.

13. The method of claim 10, wherein said controlling step alternately applies a positive and a negative voltage to the row electrodes.

14. The method of claim 13, wherein said controlling step simultaneously applies a first voltage to a first column electrode and a second voltage to a second column electrode, said first voltage exceeding said second voltage.

15. The method of claim 14, wherein said controlling step selects a refresh rate for the first column electrode to be greater than a refresh rate for the second column electrode.

16. The method of claim 13, wherein said controlling step simultaneously applies the first voltage to the first column electrode, the second voltage to the second column electrode and a third voltage to a third column electrode, said third voltage exceeding said first voltage.

17. A controller for an electroluminescent display comprising:

a memory for storing brightness information of a video frame for each of a plurality of pixels of a row of the display;

a row driver for generating voltages for a row terminal corresponding to the row; and a column driver for controlling an apparent brightness of each pixel over the video frame based upon the brightness information, said column driver controlling the apparent brightness of each pixel over the video frame by dividing the video frame into a plural total number of cycles of equal duration and applying, to a column terminal corresponding to the pixel, a selected one of a plurality of different voltages during each of the cycles, wherein each pixel exhibits one of a plurality of brightnesses when activated by applying thereto a combination voltage formed of a respective one of the different voltages and the voltage applied to the row terminal, where one of the combination voltages is zero and where a pixel to which the zero voltage is applied exhibits zero brightness, wherein a number of cycles in the video frame in which a non-zero voltage is applied to the pixel constitutes a refresh rate for the pixel for the video frame, wherein the refresh rate is selected to be a number from zero to the total number of cycles, wherein each non-zero voltage applied to the pixel during the video frame has a polarity opposite to a polarity of a just preceding non-zero voltage applied to the pixel during the video frame, and wherein the apparent brightness of the pixel over the video frame is determined by the selected refresh rate and the selected voltage applied in each cycle in accordance with the brightness information of the video frame.

18. The controller of claim 17, wherein said column driver simultaneously applies a first voltage to a first column terminal and a second voltage to a second column terminal, said first voltage exceeding said second voltage.

19. The column driver of claim 17, wherein said column driver selects a refresh rate for said first column electrode to be greater than a refresh rate for said second column electrode.

20. The controller of claim 19, wherein said column driver simultaneously applies a first voltage to a first column terminal and a second voltage to a second column terminal, said first voltage exceeding said second voltage.

* * * * *